United States Patent [19]

Coulboy et al.

[11] 4,171,922

[45] Oct. 23, 1979

[54] PROCESS FOR POSITIONING AND JOINING DUCTS OF A BLOCK

[75] Inventors: Rene H. Coulboy, Sausset-les-Pins; Francois C. Gueuret, Voisins le Bretonneux; Jean-Marie Gueguen, Marseilles; Jean-Guy Gallet, Sausset-les-Pins; Roger A. Marquaire, La Celle Saint-Cloud, all of France

[73] Assignee: Seal Participants (Holdings) Limited, Hamilton, Bermuda

[21] Appl. No.: 887,912

[22] Filed: Mar. 17, 1978

[30] Foreign Application Priority Data

Mar. 18, 1977 [FR] France ..... 77 08210

[51] Int. Cl.[2] ..... E21B 7/12

[52] U.S. Cl. ..... 405/169; 405/188; 166/341

[58] Field of Search ..... 61/69 R, 110, 86; 166/0.6, 341; 175/7; 29/137 A; 405/169, 188

[56] References Cited

U.S. PATENT DOCUMENTS

| | | | |
|---|---|---|---|
| 3,688,840 | 9/1972 | Curington et al. | 166/0.6 |
| 3,795,114 | 3/1974 | Cremiers | 61/69 R |
| 3,840,071 | 10/1974 | Baugh et al. | 166/0.6 |
| 4,080,025 | 3/1978 | Garnier et al. | 166/0.6 |

*Primary Examiner*—Jacob Shapiro

*Attorney, Agent, or Firm*—Sughrue, Rothwell, Mion, Zinn and Macpeak

[57] ABSTRACT

In the automatic positioning of one submerged unit relative to another submerged unit without the use of guide lines, guiding structures associated with the units are brought into contact and the units are relatively orientated before the units are brought into contact.

12 Claims, 9 Drawing Figures

31
35
36
37
38
39
40
41
42
43
44
45
46
47
48
49
50
51

PROCESS FOR POSITIONING AND JOINING DUCTS OF A BLOCK

The invention relates to the positioning onto and connection of a submerged unit, such for example as a production well head, a manifold or a drilling tool to an immersed stationary unit, such as a drilling well head, production well head, manifold or any other similar piece of equipment.

A variety of methods are used to make connections of this kind, inter alia with the use of guiding lines. Unfortunately, the known methods cannot readily be used at great depths and it becomes necessary to use relatively complex approach facilities which, although they have damping or guiding means, require very accurate approach control so that a connection can first be made between parts of the units to be connected, e.g., by making a preliminary connection of a central tube, before final positioning or location and connection.

According to one aspect of the present invention there is provided a method of automatically positioning a first submerged unit relative to a second submerged unit without the use of guide lines, said units being each provided with a guiding structure, said method comprising bringing said guiding structures into contact, and, while maintaining a gap between said units, orientating one of said units relative to the other of said units.

According to another aspect of the present invention there is provided apparatus for use in carrying out the method described above comprising a first guiding structure for connection to one unit which is movable and a second guiding structure for connection to the other unit which is stationary, said first guiding structure including a frusto-conical part, reciprocating actuator means, and means mounting said frusto-conical part on said reciprocating actuator for reciprocating movement axially of said frusto-conical part.

The invention will be more fully understood from the following description of an embodiment thereof, given by way of example only, with reference to the accompanying drawings which show by way of nonlimitative example an embodiment of the structures used to carry into effect the method of direct connection of ducts without any partial connection previous to the final uniting of the units carrying the ducts to be connected.

Figure 1:
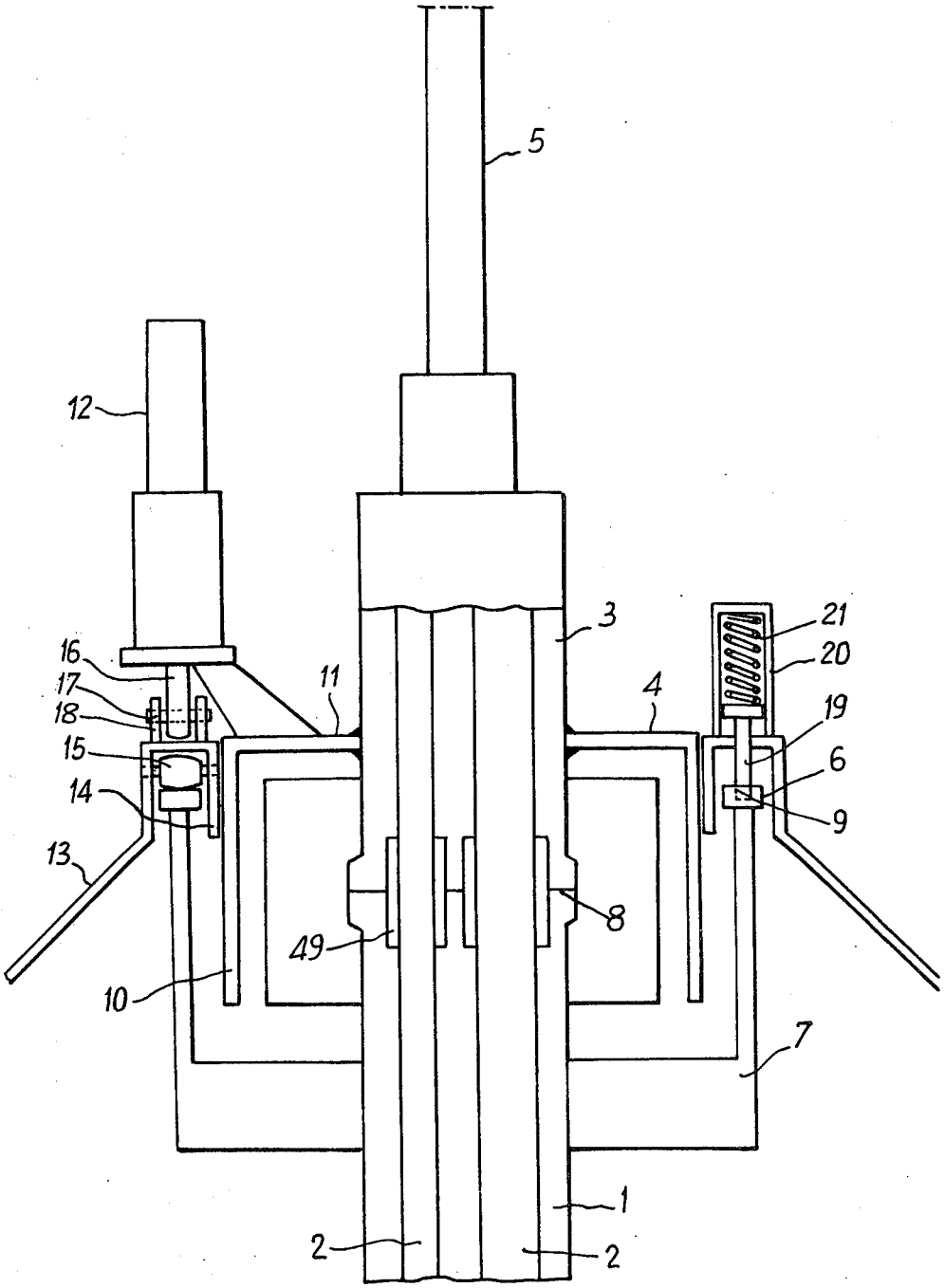
FIG. 1 is a partial diagrammatic view in section of an embodiment according to the present invention after the units have been connected.

Referring to FIG. 1, a stationary unit 1, to which a movable unit 3 is to be connected, comprises two tubes 2 which can be of any sizes and in any relative positions. The movable unit 3 also comprises similar tubes which terminate in sealing sleeves 49 or the like.

The guiding structure of the unit 1 comprises a bearing and running ring 6 carried on ribs 7 welded or bolted to the unit 1. The ring 6 has a location indicator, in the form of an aperture 9, for determining the correspondence between predetermined positions on the ring 6 and surface 8 of unit 1.

The unit 3 has a guiding structure in the form of a first cylindrical part 10 on the upper surface 11 of which reciprocating dampers 12 are mounted. Cylindrical part 10 serves to guide a cylindrical part 14 connected to a frusto-conical member 13. The part 14 is rigidly secured to piston 16 of damper 12 by means of a spindle 17 mounted in lugs 18 rigidly secured to the part 14. Through the agency of rollers 15 disposed inside the cylindrical part 14, the system comprising the unit 3, damper 12 and the double guide elements 10, 13 can run on the ring 6.

A locking finger 19 of the roller system 15 is biased downwardly by a spring 21 retained in a cylinder 20 rigidly secured to the part 14. When the finger 19 registers with the aperture 9 in the ring 6, the spring 21 urges the finger 19 into engagement in the aperture 9 and locates the guiding structure of the unit 1 to the structure 7 of the guiding system of the unit 3.

Figure 2:
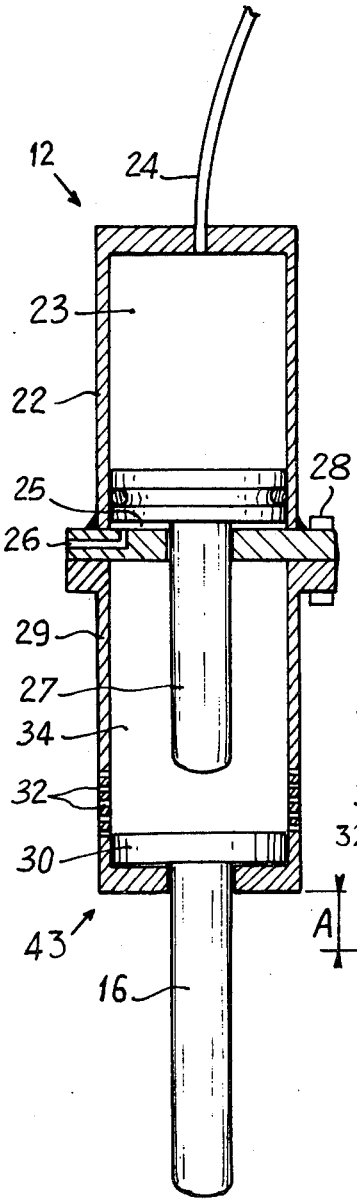
FIGS. 2, 3 and 4 show an embodiment of a damper in the various positions which it takes during positioning of the units.
Figure 3:
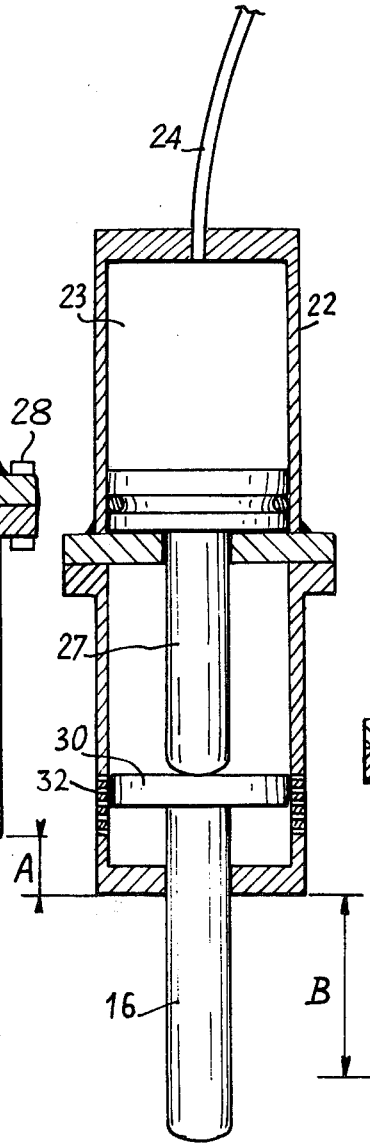
Figure 4:
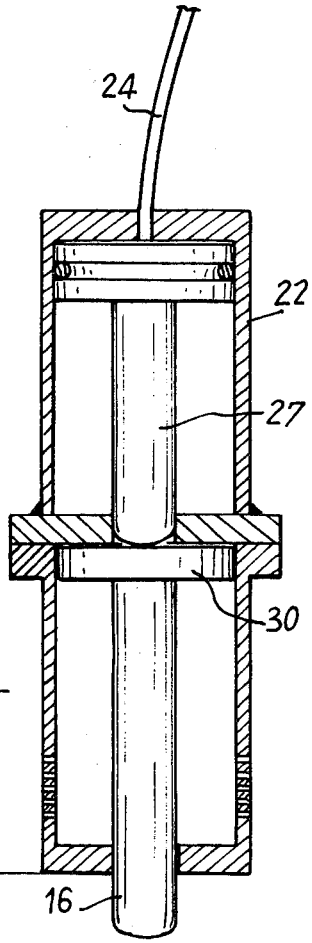
Figures 5, 6, 7, 8, 9:
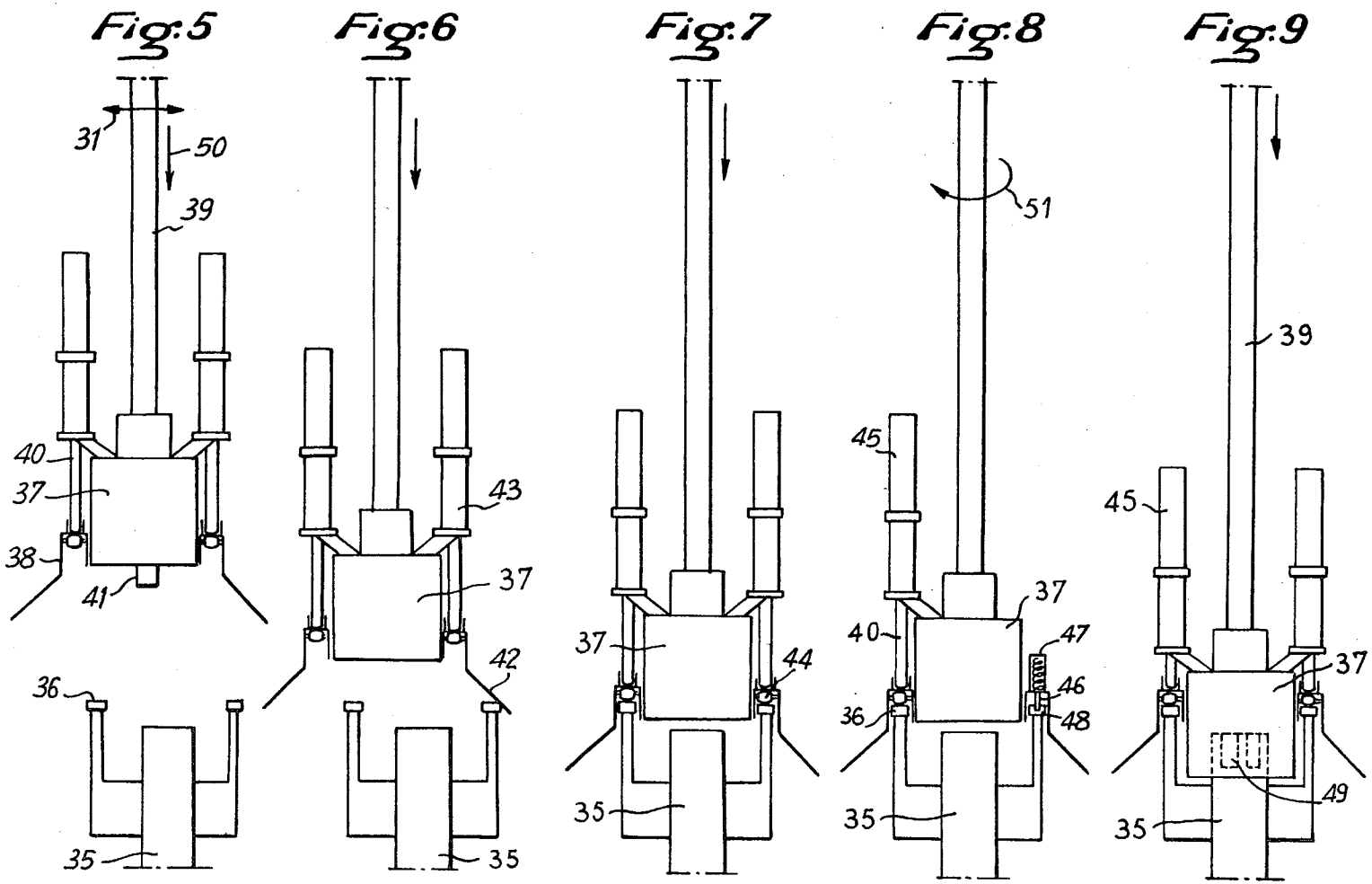
FIGS. 5 to 9 show the respective approach, partial contact, full contact, final location and connection positions of the assembly formed by the units and guiding structures.

Each damper 12 may be as shown in FIGS. 2 to 4. It comprises a standard commercial damper 22 those upper chamber 23 is connected to a unit at or above the surface of the water by a control pipe 24 and whose lower chamber 25 communicates with the exterior via an orifice 26 for pressure balancing purposes. A membrane or balloon or the like (not shown) extends round the orifice 26 to preclude any contact between the oil of the damper and the surrounding water. The rod 27 of the piston extends into the damper device which comprises a cylinder 29 serving as the casing of a ram or the like and in which slides a piston 30 having a rod 16 which extends out of the lower end of cylinder 29. Water can flow between the inside and the outside of cylinder 29 by way of orifices 32 in the lower part of the wall of the cylinder 29.

Operation of the damper is shown in FIGS. 2 to 4. FIG. 3 shows the damper as it is being lowered from the surface of the water, the chamber 23 and pipe 24 being both full of oil. This condition is maintained during lowering by maintaining the pipe 24 closed at the surface. The chamber 34 is full of water, the rod 16 being fully extended because of the load on it as a result of its connection by way of the spindle 17 to the guiding structures 13, 14.

FIG. 3 shows the position which the damper rod 16 takes up upon abutment of the roller 15 with the ring 6. The movement of the piston 30 increases the pressure of the water in cylinder 34, so that the water is expelled through the orifices 32, the shock of the abutment or impact thus being damped by the throttling of the water in its passage through the orifices 32. When the piston 30 reaches the orifices 32, its already reduced speed drops to zero as it covers the upper orifices 32. It simultaneously makes contact with the rod 27 of the piston of the device 22. Since the chamber 23 has no communication with the exterior, the piston 30 stops after it has travelled the predetermined distance A.

The pressure which the chamber 34 experiences upon impact is transmitted to the cross-section of the rod 27. The pressure in the chamber 23 therefore depends upon the ratio between the cross-sections of the rod 27 and of the piston of the device 22. This feature ensures that the impact pressure is not retransmitted to the hydraulic control circuit.

When the pipe 24 is connected to the exterior at the surface, the chamber 23 empties so that the cylinder 22 descends relative to its piston and, therefore, the cylinder of the damper 29 descends by a distance B.

FIGS. 5 to 9 show diagrammatically the various phases of lowering of a movable unit and its guiding structure onto a stationary unit and guiding structure. The stationary unit 35, which has already been placed on the seabed and which is provided with a ring 36, and the movable unit 37, to be connected to the unit 35, can be of any kind. More particularly, the unit 37 may be provided with, in addition to a frusto-conical part 42 connected at its upper end 38 to rods 40 of dampers 43, means for controlling the approach of unit 37 to unit 35 as the unit 37 is lowered by means of a string or rods 39. In the embodiment shown, the approach control includes either sonor or a television camera 41 in a pipe. The control means enables the position of the rods 39 to be altered laterally in the direction 31 so that, when the control facility 41 is near the unit 35, the operator can be certain that only a downward movement in the direction 50 is required for the frusto-conical part 42 to contact the ring 36 in the manner shown in FIG. 6. The detector in the pipe may be removed before the assemblies are brought into contact. The shock arising from the guiding part 42 abutting the ring 36 is absorbed by the dampers 43. If the lowering movement is continued, the units 35, 37 will come to the position shown in FIG. 7 where they are still some distance apart from one another. This separation or gap is the result of stopping the lowering movement either before the pistons of the damper rods 40 abut the rods of the devices 45—i.e., before the rollers 44 in the cylindrical part 38 start to receive an appreciable load—or at the time when the dampers 45 halt movement of the rods 40.

The rods 39 are then rotated to bring the ducts of the units 35, 37 into registration with one another automatically, a locking and locating finger 46 being biassed by a spring 47 to engage in an aperture 48 in the ring 36 after the unit 37 has rotated by the required amount on the rollers 44.

Since the units 35, 37 are by now properly oriented, the upper chambers of the devices 47 are evacuated, so that the unit 37 connected to the rods 39 descends until the two units 35, 37 are in contact with one another. Sealing-tightness between the ducts can be achieved by any suitable means. Preferably at least one tube 49 is provided which is rigidly connected to the end of an upper duct which is introduced into a corresponding part of a lower duct, the tube 49 having gaskets. The resulting assembly is then locked by means of any appropriate known connector (not shown). Any other required operations can then be carried out, e.g., pressure testing as a check on sealing tightness.

The invention is applicable to all kinds of connections, whether they are for ducts or pipes or for electrical connections. The invention is also applicable to anchorage devices requiring accurate location.

In a modification, more particularly when rods 39 are not available, the rollers 44 can be rotated by motors, inter alia electric motors.

Instead of rollers, ordinary runners could be used, the unit being turned by motor-driven screws for applying a torque to the unit.

Many detail modifications could of course be made to the structures shown without departure from the scope of the invention; for instance, the frusto-conical part may be made of a metal sheet or may take the form of welded tubes forming generatrices of the frusto-cone shown.

There is thus provided an automatic positioning and connection method and apparatus whereby, to facilitate positioning, each of the units carrying ducts with or without an axial tube is associated with a guiding structure, and the guiding structures are made to coincide in position and orientation while a gap is left between the units to be connected, whereafter the movable unit is lowered relatively to its guiding structure to bring it into contact with the other unit and to connect all the ducts in a single step.

Consequently, whatever kind of damper is used, there is no shock anywhere, particularly as regards the ducts, for the structures can be so devised that the units are still far enough away from one another when the guiding structures contact one another. The connecting step can therefore proceed without any vertical or lateral shock, since the moving unit descends only upon completion of the horizontal positioning necessary for automatic connection of all the ducts.

Stoppage of the damping arising from the guiding structures of the two units contacting one another is controlled automatically for a given position of one such structure relatively to the other so as to maintain a preset gap or space between the two units throughout the phase in which one unit is oriented relatively to the other.

The structures can therefore be moved rapidly into their predetermined coincidence positions, in preparation for connection of the units, with a higher degree of reliability than has previously been possible.

What is claimed is:

1. A method of automatically positioning a first submerged unit relative to a second submerged unit without the use of guide lines, said units being each provided with a guiding structure, one of said guiding structures comprising an annular member and the other of said guiding structures comprising a frusto-conical part connected at its smaller end to a cylindrical part having a diameter corresponding to that of said annular member and comprising means for rolling on said annular member, said method comprising bringing said guiding structures into contact, causing said rolling means to roll on said annular member, and, while maintaining a gap between said units, orientating one of said units relative to the other of said units.

2. A method as claimed in claim 1, including, before orientating said units, causing said frusto-conical part to move into axial alignment relative to said annular part.

3. A method as claimed in claim 1, including determining said gap by causing movement of said frusto-conical part relative to the one of said units to which it is connected by contact between said frusto-conical part and said annular member.

4. A method as claimed in claim 1, including bringing said units into contact after relative orientation of said units by causing one of said units to move relative to said frusto-conical part.

5. A method as claimed in claim 4, wherein said relative movement between said frusto-conical part and said one of said units is caused by the weight of said unit and operation of means connected to said frusto-conical part.

6. A method as claimed in claim 1, said method including, before said guiding structures are brought into contact, moving one of said units relative to the other of said units using detector means placed in a tube secured to one of said units, until said frusto-conical part surrounds said annular member.

7. Apparatus for automatically positioning a first submerged unit relative to a second submerged unit comprising a first guiding structure for connection to one unit which is movable and a second guiding structure for connection to the other unit which is stationary, said first guiding structure including a frusto-conical part, said second guiding structure including an annular member, said first guiding structure including a cylindrical part to which said frusto-conical part is connected at its upper end, said cylindrical part having a diameter corresponding to that of said annular member, said cylindrical part including means for rolling on said annular member, reciprocating actuator means, and means mounting said frusto-conical part on said reciprocating actuator for reciprocating movement axially of said frusto-conical part.

8. Apparatus for automatically positioning a first submerged unit relative to a second submerged unit comprising a first guiding structure for connection to one unit which is movable and a second guiding structure for connection to the other unit which is stationary, said first guiding structure including a frusto-conical part, said second guiding structure including an annular member, said first guiding structure including a cylindrical part to which said frusto-conical part is connected at its upper end, said cylindrical part having a diameter corresponding to that of said annular member, said cylindrical part including means for sliding on said annular member, reciprocating actuator means, and means mounting said frusto-conical part on said reciprocating actuator for reciprocating movement axially of said frusto-conical part.

9. Apparatus for automatically positioning a first submerged unit relative to a second submerged unit comprising a first guiding structure for connection to one unit which is movable and a second guiding structure for connection to the other unit which is stationary, said first guiding structure including a frusto-conical part, said second guiding structure including an annular member, said first guiding structure including a cylindrical part to which said frusto-conical part is connected at its upper end, said cylindrical part having a diameter corresponding to that of said annular member, said annular member being formed with a locating aperture and said cylindrical part having a spring-biased locating finger adapted to engage in said aperature to locate said frusto-conical part relative to said annular member, reciprocating actuator means, and means mounting said frusto-conical part on said reciprocating actuator for reciprocating movement axially of said frusto-conical part.

10. Apparatus for automatically positioning a first submerged unit relative to a second submerged unit comprising a first guiding structure for connection to one unit which is movable and a second guiding structure for connection to the other unit which is stationary, said first guiding structure including a frusto-conical part, said second guiding structure including an annular member, said first guiding structure including a cylindrical part to which said frusto-conical part is connected at its upper end, said cylindrical part having a diameter corresponding to that of said annular member, reciprocating actuator means comprising damping means disposed between rods of said actuator and supports thereof, said damping means being connected to said cylindrical part, and means mounting said frusto-conical part on said reciprocating actuator for reciprocating movement axially of said frusto-conical part, wherein an upper chamber of said actuator means is connected to means for filling said chamber with fluid or for emptying fluid from said chamber, a lower chamber of said actuator means being at the same pressure as the outside medium, said actuator rod extending into a damping cylinder which extends said actuator means and which comprises a piston adapted to bear on the actuator rod and to close a plurality of orifices in the lower part of said damper cylinder, the end of said damper rod being rigidly connected to said first guiding structure.

11. Apparatus as claimed in claim 10, wherein said damper rod is connected to said cylindrical part, said cylindrical part containing rollers for running on said annular member.

12. Apparatus as claimed in claim 10, wherein said damping means is rigidly secured to a cylindrical guide means for protecting said movable unit, said cylindrical part extending above said frusto-conical part which extends along said guide means for protecting said movable unit.

* * * * *